US006893058B2

(12) United States Patent
Kumar et al.

(10) Patent No.: US 6,893,058 B2
(45) Date of Patent: May 17, 2005

(54) RAILWAY TRAIN FRICTION MANAGEMENT AND CONTROL SYSTEM AND METHOD

(75) Inventors: Ajith Kuttannair Kumar, Erie, PA (US); Vishwesh M. Palekar, Erie, PA (US); Anthony Giammarise, Erie, PA (US); Chi-Houng E. Lu, Erie, PA (US); John Polley, Erie, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/606,722

(22) Filed: Jun. 26, 2003

(65) Prior Publication Data

US 2004/0075280 A1 Apr. 22, 2004

Related U.S. Application Data

(60) Provisional application No. 60/419,673, filed on Oct. 18, 2002.

(51) Int. Cl.[7] ..... B60B 39/00
(52) U.S. Cl. ..... 291/2; 104/279
(58) Field of Search ..... 104/279, 280; 291/2, 12, 13

(56) References Cited

U.S. PATENT DOCUMENTS

| | | | |
|---|---|---|---|
| 4,230,045 | A | 10/1980 | Fearon |
| 4,634,545 | A | 1/1987 | Zaleski et al. |
| 4,726,448 | A | 2/1988 | Schroeder et al. |
| 4,781,121 | A | 11/1988 | Kumar et al. |
| 4,915,856 | A | 4/1990 | Jamison |
| 4,930,600 | A | 6/1990 | Kumar et al. |
| 4,992,568 | A | 2/1991 | Larock |
| 5,060,335 | A | 10/1991 | Webster |
| 5,086,591 | A | 2/1992 | Panetti |
| 5,134,808 | A | 8/1992 | Panetti |

(Continued)

*Primary Examiner*—S. Joseph Morano
*Assistant Examiner*—Robert J. McCarry, Jr.
(74) *Attorney, Agent, or Firm*—Senniger Powers; Carl Rowold

(57) ABSTRACT

A system and method for friction management for managing and controlling an application of a friction modifying agent to an area of contact between a railway wheel and a railway rail over which the wheel is traversing to selectively modify the coefficient of friction at the contact area. The system comprises a sensor for detecting a parameter relating to the operation of the railway train. A controller is responsive to the sensor and controls the application of a friction modifying agent to the rail as a function of the parameter. An applicator is responsive to the controller and applies the friction modifying agent to the area of contact between the railway wheel and rail. The invention also includes a method for railway train friction management for managing and controlling the application of friction modifying agent to an area of contact between railway wheel and railway rail over which the wheel is traversing to selectively modify the coefficient of friction at the contact area. The method comprises sensing a parameter related to the operation of the railway train and applying the friction modifying agent to the area of contact between the railway wheel and rail as a function of the sensed parameter.

53 Claims, 10 Drawing Sheets

U.S. PATENT DOCUMENTS

| | | | | |
|---|---|---|---|---|
| 5,158,694 | A | | 10/1992 | Waynick |
| 5,173,204 | A | | 12/1992 | Chiddick et al. |
| 5,251,724 | A | | 10/1993 | Szatkowski et al. |
| 5,358,072 | A | | 10/1994 | Szatkowski et al. |
| 5,477,941 | A | | 12/1995 | Kumar et al. |
| 5,492,642 | A | | 2/1996 | Mulvihill et al. |
| 5,687,814 | A | | 11/1997 | Craig et al. |
| 5,722,509 | A | | 3/1998 | Clinger |
| 5,726,448 | A | | 3/1998 | Smith |
| 5,775,228 | A | | 7/1998 | Lamba et al. |
| 5,896,947 | A | * | 4/1999 | Kumar ..... 184/3.2 |
| 5,919,295 | A | | 7/1999 | Lamba et al. |
| 5,992,568 | A | | 11/1999 | Craig et al. |
| 6,073,346 | A | | 6/2000 | Runkle |
| 6,136,757 | A | | 10/2000 | Chiddick |
| 6,170,610 | B1 | | 1/2001 | Kumar |
| 6,186,411 | B1 | | 2/2001 | Sich |
| 6,199,661 | B1 | | 3/2001 | Kumar |
| 6,254,696 | B1 | | 7/2001 | Ueda et al. |
| 6,276,281 | B1 | * | 8/2001 | Mesalic et al. ..... 104/279 |

* cited by examiner

| Direction when Active | Fwd 102 & 104 | Rev 106 & 108 | | Fwd 110 & 112 | Rev 114 & 116 |
|---|---|---|---|---|---|
| Sand Functions | Lead Axle or Trainline or Auto | Trainline or Auto | | Trainline or Auto | Lead Axle or Trainline or Auto |

128

RAILWAY TRAIN FRICTION MANAGEMENT AND CONTROL SYSTEM AND METHOD

CROSS REFERENCE TO RELATED APPLICATIONS

This application claims priority to U.S. Provisional Patent Application No. 60/419,673, filed on Oct. 18, 2002, the entire disclosure of which is incorporated herein by reference.

BACKGROUND OF THE INVENTION

1. Field of the Invention

The invention relates generally to railroad friction enhancing and friction reducing systems. More particularly, the invention relates to systems and methods for automatically controlling the application of the cohesion or friction modifiers to a railway system.

2. Background

Locomotives and transit vehicles as well as other large traction vehicles are commonly powered by electric traction motors coupled in driving relationship to one or more axles of the vehicle. Locomotives and transit vehicles generally have at least four axle-wheel sets per vehicle with each axle-wheel set being connected via suitable gearing to the shaft of a separate electric motor commonly referred to as a traction motor. In the motoring mode of operation, the traction motors are supplied with electric current from a controllable source of electric power (i.e., an engine-driven traction alternator) and apply torque to the vehicle wheels which exert tangential force or tractive effort on the surface on which the vehicle is traveling (i.e., the parallel steel rails of a railroad track), thereby propelling the vehicle in a desired direction along the right of way.

Locomotives used for heavy haul applications typically must produce high tractive efforts. Good adhesion between each wheel and the surface is required for efficient operation of the locomotive. The ability to produce these high tractive efforts depends on the available adhesion between the wheel and rail. Many rail conditions such as being wet or covered with snow or ice require an application of friction enhancing agent such as sand to improve the adhesion of the wheel to the rail. Therefore, locomotives typically have sand boxes on either end of the locomotives, and nozzles to dispense the sand (both manually and automatically) to the rail on either side of the truck.

Maximum tractive or braking effort is obtained if each powered wheel of the vehicle is rotating at such an angular velocity that its actual peripheral speed is slightly higher (motoring) than the true vehicle speed, i.e., the linear speed at which the vehicle is traveling, usually referred to as "ground speed" or "track speed". The difference between tractive wheel speed and track speed is referred to as "creepage" or "creep speed." There is a variable value of creepage at which peak tractive effort is realized. This value, commonly known as the optimal creep setpoint is a variable that depends on track speed and rail conditions. So long as the allowable creepage is not exceeded, this controlled wheel slip is normal and the vehicle will operate in a stable microslip or creeping mode. If wheel-to-rail adhesion tends to be reduced or lost, some or all of the tractive wheels may slip excessively, i.e., the actual creep speed may be greater than the maximum creep speed. Such a gross wheel slip condition, which is characterized in the motoring mode by one or more spinning axle-wheel sets, can cause accelerated wheel wear, rail damage, high mechanical stresses in the drive components of the propulsion system, and an undesirable decrease of tractive effort.

The peak tractive effort (TE) limits the pulling/braking capability of the locomotive. This peak tractive effort is a function of various parameters, such as weight of the locomotive per axle, wheel rail material and geometry, and contaminants like snow, water, grease, insects and rust. Contaminants in the wheel/rail interface reduce the maximum adhesion available, even at the optimal creep setpoint.

While the locomotives most often require friction enhancing agents, locomotives also require, in some situations, the application of a lubricant to reduce the wear of the locomotive wheel flanges. For example, when a locomotive is traversing a section of track with a curve. For a locomotive or a consist of locomotives that are always oriented in the same way, maximum benefit for wheel-rail wear of both the cars and the locomotives is provided by lubricating the gage side of the rail or wheel flanges on the high rail in the front and simultaneously lubricating the top of the two rails in the trailing end of the locomotive or the locomotive consist. Control of the rail gage side (RAGS) lubricator as well as the top of rail (TOR) lubricator can be done by the same controller for one locomotive or two controllers located in different locomotives for the case of a locomotive consist.

While locomotive often require increased cohesion, generally non-locomotive railway cars trailing the locomotives operate most efficiently at lower cohesion or friction levels. As such ,friction and therefore pull weight of railway cars. Lubricant applied to the top of the rail and possibly to the gage side of the rail behind the last axle of the last locomotive results in reduced friction and wear of the trailing car wheels. In other systems, such as a flange lubrication system, grease is applied to the flanges of the locomotive wheels in order to reduce friction between the flange and the wheel thereby reducing fuel usage and increase rail and wheel life. The system dispenses a controlled amount of lubrication, based on locomotive speed and direction, to the inside flange of wheel to lubricate the wheel/flange interface on the trailing axles of the locomotive/train. Presently, nozzle placement is based on customer choice, and the nozzles can be applied to multiple axles and always in pairs (left and right side). The lubrication is typically of a graphite base.

It is desirable to reduce the coefficient of friction for the trailing cars as the reductions in the coefficient of friction directly reduces the pull weight and directly improves the fuel efficiency of the locomotive consist. Managing the coefficient of friction of the cars can result in a 10 to 30 percent increase in fuel efficiency.

FIG. 1 illustrates a typical prior art locomotive 122 having a friction modifying agent to increase the coefficient of friction. In this case the friction modifying agent is sand and the sanding system applies sand to the rails. Sand is stored in a short hood sand box 118 or a long hood sand box 120. The illustrated example includes eight sand nozzles 102–116. In the illustrated example, the locomotive 122 has two trucks 124 and 126; the front truck 124 has one nozzle in the front left 102, one nozzle in the front right 104, one nozzle in the rear left 106, and one nozzle in the rear right 108. The rear truck similarly has one nozzle in the front left 110, one nozzle in the front right 112, one nozzle in the rear left 114, and one nozzle in the rear right 116. Chart 128 of FIG. 1 illustrates when each of the nozzles are active. For example, sand nozzle 114 is active in the reverse direction if lead axle sand or auto sand or trainline sand is enabled.

FIG. 2 illustrates a prior art schematic diagram of the sanding system 200 of FIG. 1. The system 200 includes a compressed air reservoir 202, one sand box for each truck 204 for the front and 206 for the rear, one manual air valve for each truck (208 for the front truck and 210 for the rear truck), two electrically controlled sand valves for each truck (212 and 214 for the front truck and 216 and 218 for the rear truck), and two nozzles for each of these electrically controlled sand valves (102 and 104 for the forward front truck valves, 106 and 108 for the reverse front truck valves, 110 and 112 for the forward rear truck valves, 114 and 116 for the reverse rear truck valves). A locomotive control system 220 enables the appropriate sand valves based on the inputs from the operator or train lines, or when an adhesion control system determines that the rail conditions are poor and sanding will yield a higher tractive effort. Lubricants may be applied to the top of the rail or to the rail gage side in a similar manner (not illustrated).

FIG. 3 illustrates an exemplary adhesion creep curve 300 for a locomotive traversing a rail. As illustrated, curve 302 depicts the adhesion characteristics of dry sand that provides the highest level of adhesion for each level of per unit creep especially at per unit creep levels of less than 0.2. For per unit of creep levels of less than 0.05, wet sand as depicted by curve 304 provides a higher adhesion than a dry rail as shown by curve 306. However, at per unit creep levels greater than 0.05, wet sand curve 304 has less adhesion than the dry rail curve 306. For the situations where less adhesion is desirable, as is the case for connected railway cars or a locomotive rounding a curve in a track, oil as depicted by curve 308 provides the least amount of adhesion for per unit creep less than 0.1. Curve 310 illustrates the adhesion characteristics of water that also provides improved reduced friction as compared to a dry rail (curve 306) for per unit creep. From chart 300, it is desirable to manage the friction between a wheel of a locomotive or a railway car and the railway rails in a manner that enhances the tractive effort of the locomotive while at the same time reducing the friction of railway cars connected to the locomotive.

Chart 400 in FIG. 4 illustrates two changes in the operating point of a wheel on a wet rail when sand is applied to the wet rail (curve 402) and when sand is removed from the rail (curve 404). For example, if sand is applied to a wet rail at point 406 on water curve 310, curve 402 illustrates that the creep decreases to point 408, a point on wet sand curve 304. Similarly, if water is applied to a rail operating at point 408 on the wet sand curve 304, the removal of the wet sand moves the creep from point 408 to point 406 on curve 310, thereby indicating a significant increase in creep. FIG. 4 also illustrates optimal adhesion control system performance—creep is controlled such that maximum tractive effort is attained (assuming that the operator is calling for more tractive effort than what can be sustained by the rail conditions). Therefore, such a change can be observed by the adhesion control system only when the available adhesion at the wheel is utilized by the wheel and it typically happens at high tractive effort, low speed operating conditions. At other operating conditions the tractive effort versus creep characteristics change but not as dramatically.

In this illustration, a locomotive is applying 17,000 pounds of tractive effort. However, at point 406 the rail is wet and the wheels are experiencing a per unit creep of more than 0.14. Sand is applied immediately prior to the advancing wheel of the locomotive. As a result, at point 408 tractive effort is increased to 20,000 pounds and per unit creep is reduced to less than 0.03. If the sand is later removed, the operating point returns from point 408 to the prior operating point 406. This illustrates the benefits of both applying a friction enhancing agent, in this case sand, and the subsequent removal of the sand to thereafter reduce the friction experienced by a trailing railway car.

FIG. 5 illustrates the tractive effort in pounds as a function of the speed of the train for eight setting tractive effort or throttle settings as denoted TE1 to TE8. As shown, for a low speed there is a significant variation in the tractive effort for each of the throttle settings. However, as speed increases, the tractive effort reduces and approaches a relatively close level as the speed exceeds 50 miles per hour. It should also be noted that for each throttle setting, the tractive effort remains constant until a break speed is reached, as denoted in FIG. 5 where each line for each tractive effort drops from the level amount to a significantly lower and decreasing amount.

BRIEF DESCRIPTION OF THE INVENTION

Therefore, there is a need for an improved system and method for automatically controlling the application of a friction modifier to the rail by railway locomotives and cars. Such a system and method monitors and assesses various factors and parameters for the purpose of friction management and control of friction modifying agent applicators to optimize the coefficient of friction to the rail for the wheel of a locomotive and the wheel of connected railway cars.

One aspect of the invention comprises a system and a method for friction management is provided for managing and controlling an application of a friction modifying agent to an area of contact between a railway wheel and a railway rail over which the wheel is traversing to selectively modify the coefficient of friction at the contact area. The system comprises a sensor 610 for detecting a parameter relating to the operation of the railway train. A controller is responsive to the sensor 610 and controls the application of the friction modifying agent to the rail as a function of the parameter. An applicator is responsive to the controller and applies the friction modifying agent to the area of contact between the railway wheel and rail.

Another aspect of the invention comprises a method for railway train friction management for managing and controlling the application of a friction modifying agent to an area of contact between a railway wheel and a railway rail over which the wheel is traversing to selectively modify the coefficient of friction at the contact area. The method comprises sensing a parameter related to the operation of the railway train and applying the friction modifying agent to the area of contact between the railway wheel and rail as a function of the sensed parameter.

DETAILED DESCRIPTION

Figure 6:
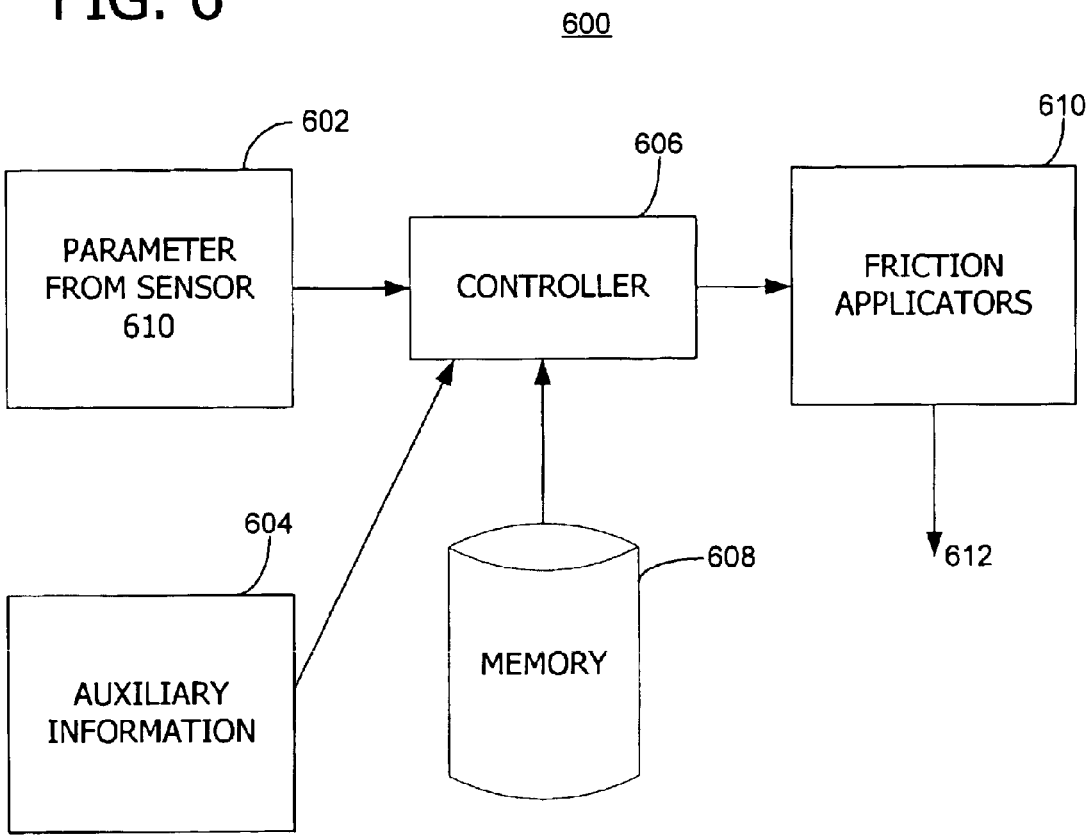
FIG. 6 is a schematic diagram of a friction management system 600 according to the present invention.

Referring now to FIG. 6, the friction management system 600 according to one embodiment of the invention comprises sensors for detecting operating parameters 602 relating to the operation of the railway train. The parameters 602 are various parameters that may be indicative of the interaction between the wheels of a railway vehicle and the rails on which the railway vehicle is traversing. These parameters 602 may include operating parameters of the locomotive such as speed of the train, tractive effort (TE), throttle or notch setting, wheel speed, rate of acceleration or deceleration, braking condition, force, wheel slip/slide, fuel consumption, wheel creep, engine horsepower, and traction motor torque. These parameters 602 may be based on a per axle, per truck, or per locomotive basis. These parameters 602 are associated with the operation of the train and/or locomotive.

Alternatively or in addition, auxiliary information or data 604, which may be in the form of a parameter, may be utilized as input for friction management of a railway wheel to the rail. These include consist/train length, train weight, track map, train location, track topography, track grade, track curvature, rail temperature, rail conditions such as dry, wet, rain, snow or ice, the presence of rail modifiers on a rail, both the current and forecasted weather, train schedules or external commands from operators or dispatch centers.

As shown in FIG. 6, operating parameters 602 and/or optional auxiliary data 604 are input into a controller 606. The controller 606 may be configured to have an optional memory 608 or storage system. The controller 606 controls one or more systems for applying a friction modifying agent 612 to the rail based on the controller 606's response to the parameters 602 and/or optional auxiliary data 604.

A locomotive or a railway car is equipped with an applicator 610 that is responsive to the controller 606. Applicator 610 applies a friction modifying agent 612 to the rail at an area of contact between the railway wheels and the rails on which they are traversing. Friction modifying agents 612 may be enhanced adhesion materials such as sand, or the removal of snow or water from the rail. Friction reducing agents may be water, steam, air, oil, a lubricant, or may be the removal of sand, water, snow or a friction enhancing agent that exists on the rail at the time. In either case, cleaning the rail with a brush, or with water or air, may be friction enhancing or friction reducing depending on the existing state of the rail. The friction management system 600 analyzes these and other operational parameters 602 and optional auxiliary data 604 to determine the appropriate timing and quantity of friction modifying agent 612 to be applied. For example, the amount of friction modifying agent 612 applied by an applicator 610 may be optimized based on the length of the train and the weather conditions such that the modifying agent 612 is consumed or dissipated by the time the last car in a train configuration passes the point of application of modifying agent 612. While the parameters 602 and auxiliary data 604 may be used or monitored for other operational purposes, they are not used for friction management.

In one embodiment of the invention, a train configuration has a plurality of applicators 610 located at positions that are before the wheels of the locomotive. As a locomotive may work in the forward or reverse directions, the locomotive may be configured with friction modifying agent applicators 610 at both ends of the vehicle. Additionally, applicators 610 may be applied to the leading end or the trailing end of a locomotive or a railway car for application of a friction modifying agent 612.

Applicators 610 are configured on the railway vehicle such as to enable the application of the friction modifying agents 612 to defined points of application. As such, it is contemplated that there will be a plurality of applicators 610 on each railway vehicle. Applicators 610 are configured to apply a friction modifying agent 612 to the wheel flange, the wheel rim, the top of the rail (TOR) and/or to the rail gage side (RAGS). The controller 606 determines the type, timing and quantity of the friction modifying agent 612 to be applied. The controller 606 determines the one or more applicators 610 among a plurality of applicators 610 located on a train, locomotive or railway car to apply the agent. Additionally, the controller 606 determines the point of application for the friction modifying agent 612 to be applied.

As noted above a plurality of applicators 610 are positioned on a locomotive and/or a railway car in order to optimize friction management of a train configuration. A train configuration is typically comprised of a lead motoring locomotive, one or more optional secondary motoring locomotives, an optional trailing motoring locomotive that is positioned in a train configuration at a point distant from the lead and secondary motoring locomotives, and one or more railway cars. The applicator, and therefore the application of friction modifying agents 612, may be positioned as a lead applicator of the lead motoring locomotive, a trailing applicator of the lead motoring locomotive, a lead applicator of the secondary motoring locomotive, a trailing applicator of the secondary motoring locomotive, a lead applicator of the trailing motoring locomotive, a trailing applicator of the trailing motoring locomotive, a lead applicator of a railway car, or a trailing applicator of a railway car. Each of these is contemplated as being managed by the friction management system 600.

The controller 606 may communicate by one or more communication systems or links (not shown) between the controller 606, locomotives and railway cars equipped with the friction management system 600.

Figure 7:
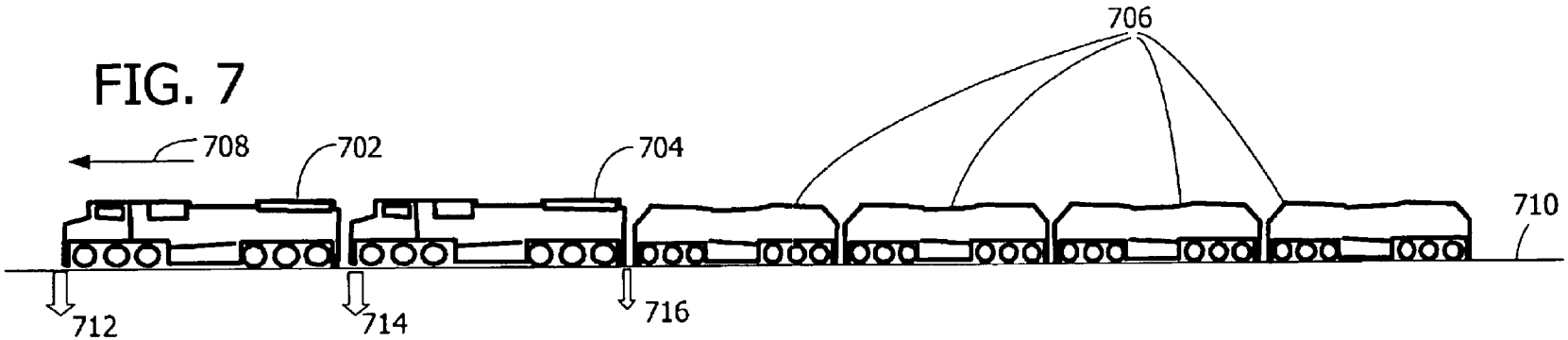
FIG. 7 is a first illustration of a configuration illustrating the location of application of friction modifying agents in a first train configuration.

FIG. 7 shows one embodiment of a train configuration. In configuration 1, two locomotives, a lead motoring locomotive 702 and a secondary motoring locomotive 704, are connected to four railway cars 706 and are moving on railway track or rail 710 in the forward direction from right to left as indicated by arrow 708. In this case applicator 712 is an applicator that applies a friction modifying agent 612 to rail 710 prior to the wheels of the lead motoring locomotive 702. Applicator 712 may apply a friction enhancing agent such as sand or may remove or neutralize an agent or material on rail 710. For example, if rail 710 is wet or covered with snow or ice, and controller 606 determines that friction enhancement is required, applicator 712 may apply air to dry the top of rail 710, or may apply steam to melt the snow or ice. Additionally, if the lead motoring locomotive 702 is entering a curved section of track, applicator 712 may apply a lubricant such as water or oil to the rail gage side of the track to reduce friction of the wheel to rail 710.

The secondary locomotive 704 is configured with applicator 714 at the leading end of the locomotive 704. The controller 606 controls the application of friction modifying agents 612 by applicator 714 based on the determined need. In some situations the controller 606 may determine that the application applied by applicator 712 on the leading locomotive 702 is sufficient for both the lead 702 and secondary 704 locomotive. This may be the case when water, snow or ice is on the track and applicator 712 is controlled to remove the water, snow or ice. However, where a steep incline is encountered, the controller 606 may control 712 and 714 to apply friction enhancing agents 612 such as sand to the top of the rail.

Also as shown in FIG. 7, applicator 716 is configured at the trailing end of the secondary motoring locomotive 704. Applicator 716 may be configured to remove or neutralize any friction enhancing agents applied by applicators 712 and/or 714. Furthermore, applicator 716 may apply a friction reducing agent such as air, water, oil or a lubricant to the top of the rail 710 or to the rail gage side to reduce the friction between the rail 710 and the wheels of the trailing railway cars 706.

Figure 8:
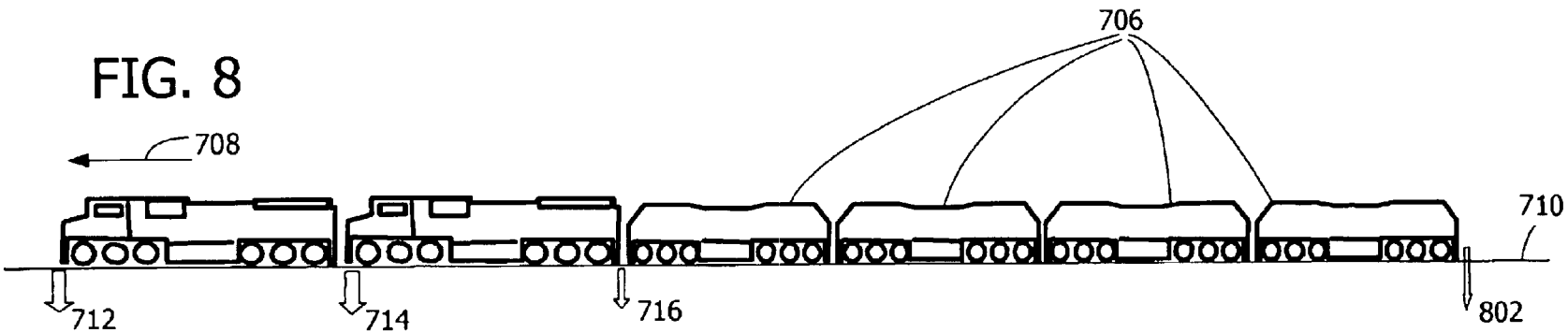
FIG. 8 is a second illustration of a configuration illustrating the location of application of friction modifying agents in a second train configuration.

Referring now to FIG. 8, a second train configuration illustrates the addition of applicator 802. Applicator 802 is located at the end of the train configuration that may be a railway car 706 as illustrated or may be a locomotive. Additionally, applicator 802 may be at the front or the rear of the last car 706 or locomotive on the train configuration. Applicator 802 is configured to remove or neutralize the friction modifying agents 612 applied earlier by applicators 712, 714 or 716. This is desirable to clean the rail 710 prior to the next train configuration using the same section of rail 710. However, the controller 606 may determine that an application of a rail cleaning agent may not be required due to the current or forecasted weather or the absence of another train to be using rail 710. For instance, if a lubricant is applied by applicator 716, controller 606 may determine that 802 need not apply a neutralizing agent if it is raining and another train is not scheduled to traverse the same rail 710 for an hour or more. Additionally, as noted earlier, if the controller 606 can determine the optimal amounts of friction modifying agent 612 to be applied to rail 710 by applicator 716 based on parameters 602 and auxiliary data 604 such as the length of the train and the weather conditions, the modifying agent 612 may be consumed or dissipated by the time the last car in a train configuration passes. In such cases, there will not be a need to cleanse the track by applicator 802.

Figure 9:
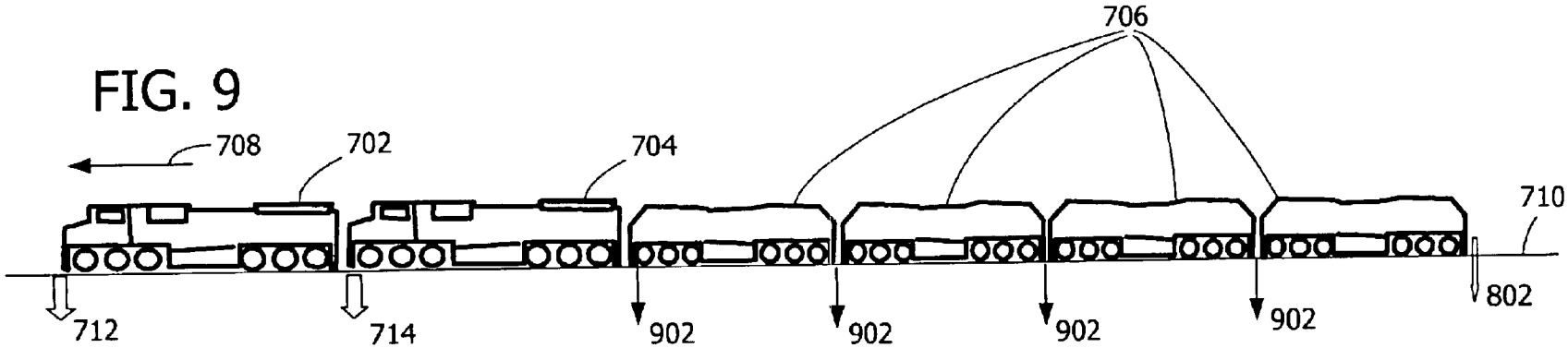
FIG. 9 is a third illustration of a configuration illustrating the location of application of friction modifying agents in a third train configuration.

Now referring to FIG. 9, as noted earlier, railway cars 706 may be configured with applicators 610 to apply friction modifying agents 612. Such applicators are indicated by 902 wherein any number of cars 706 may be in a train configuration and any number may be equipped with friction modifying applicators 902. While applicators 902 configured on railway cars 706 are often friction reducers, they may be of any type. Such applicators 902 would also be controlled by the friction management system 600, typically the same system that manages applicators 712, 714, 716, and 802. The friction management system 600 or controller 606 controls the application of friction modifying agents 612 to rail 710 and includes the application of friction reducing agents either to the top of the rail 710 or to the rail gage side if the train is traversing a section of rail 710 with a curve. In such an instance, the controller 606 may control the application of a friction reducing agent such as a lubricant on the inside of the rail. Furthermore, the controller 606 may only control the application of the lubricant by the applicators 610 on the rail on the side of the train which is towards the inside of the curve and not on the rail on the side on the outside of the curve.

Figure 10:
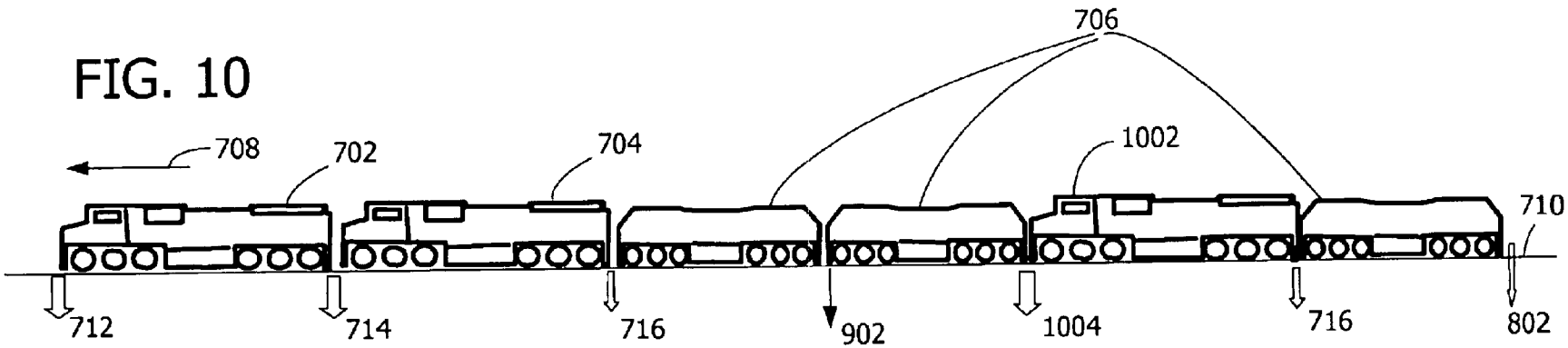
FIG. 10 is a fourth illustration of a configuration illustrating the location of application of friction modifying agents in a fourth train configuration.

Referring to FIG. 10, a train configuration may have a locomotive positioned remote from the lead 702 or secondary 704 locomotives. Such a trailing locomotive 1002 may be positioned at the end of the train configuration (not shown) or may be positioned in the middle of a train configuration (shown) such that railway cars 706 are positioned in front of and behind the trailing locomotive 1002. In this embodiment of the invention, the trailing locomotive 1002 is equipped with an applicator 1004. Applicator 1004 may apply either a friction enhancing or friction reducing agent as instructed by the controller 606. When the controller 606 determines that a friction enhancing agent will be required to improve the tractive effort of the trailing locomotive 1002, applicator 1004 may be instructed to remove or neutralize the friction reducing agent applied earlier by applicators 716 or 902, and apply a friction enhancing agent such as sand. In other situations, applicator 1004 may be instructed to apply the neutralizing agent to dry the rail that increases the coefficient of friction or may be instructed to apply sand if necessary for a particular section of rail 710 or track grade. The trailing locomotive 1002 also be configured with a applicator 716 as discussed earlier. Additionally, the trailing railway cars 706 from the trailing locomotive 1002 may be equipped with applicator 802 to cleanse the rail 710 after the train has passed.

Figure 11:
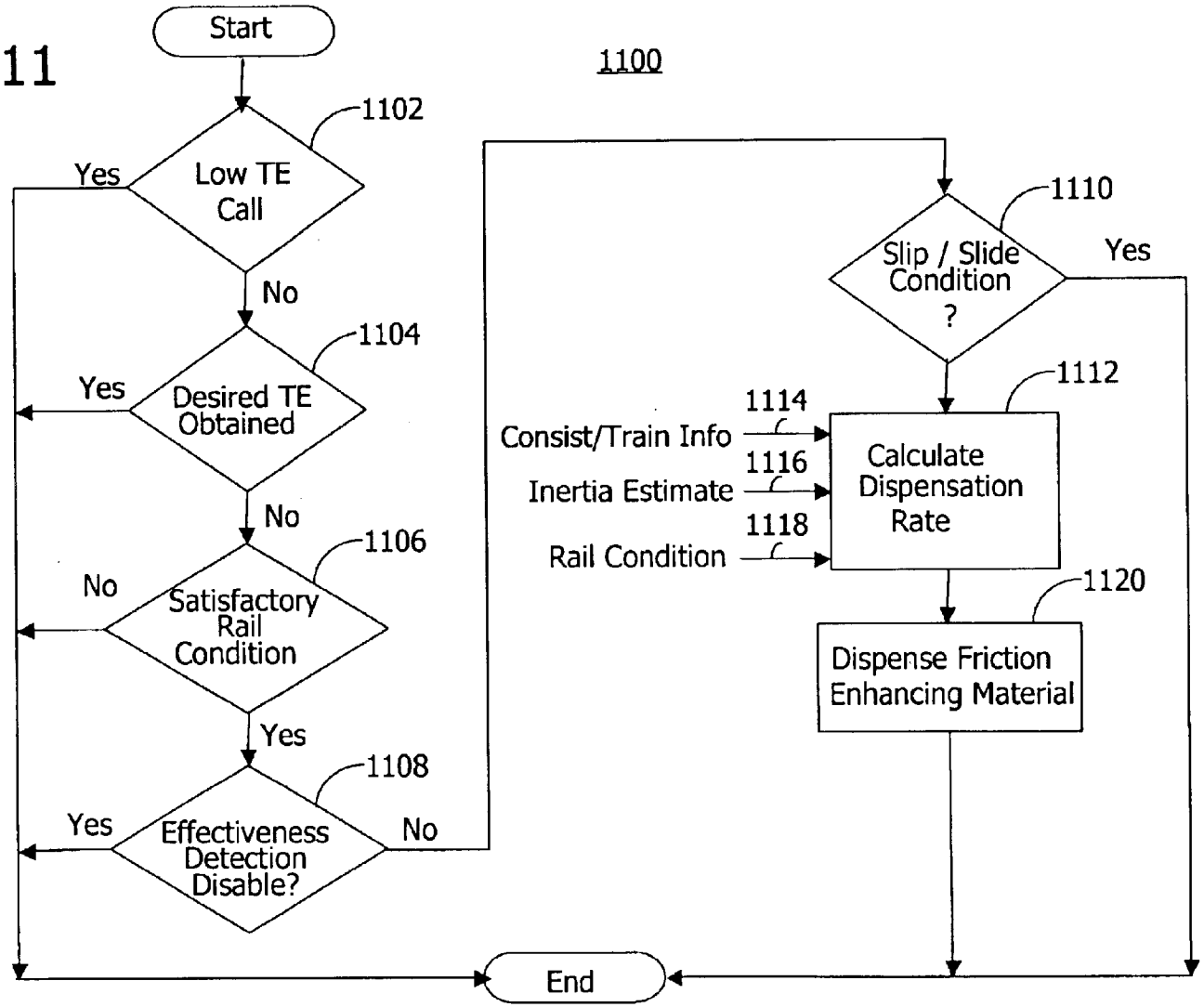
FIG. 11 is an exemplary flow chart for managing and controlling the application of a friction enhancing agent to the rails according to one embodiment of the invention.

As discussed earlier, the controller 606 receives operating parameters 602 from one or more sensors 610 on the train, or associated with the train. Additionally, the controller 606 may also receive auxiliary data 604 from other sources that affect the management and optimization of the friction between the railway wheels and the rail. FIG. 11 is one embodiment of a decision chart 1100 according to one embodiment of the invention. In FIG. 11, the train configuration is operating at a low speed and a low tractive effort has not been called 1102. In such a case, desired tractive effort, actual tractive effort, rail condition, and slip/slide condition are determined. If the desired tractive effort in 1104 is not obtained or obtainable under the present of planned situation or condition, there is satisfactory rail conditions for the desired tractive effort 1106, the effectiveness detection has not been disabled 1108, and a slip or slide condition is not present 1110, then controller 606 obtains consist or train data 1114 related to the weight of the consist, the train configuration length, an inertia estimate of the train 1116 and the rail condition 1118. The controller 606 then determines whether friction modifying agents 612 should be applied to the rail, where to apply the agents 612, which applicators 610 to activate for applying the agents 612, which agents 612 should be applied and the quantity or dispensation rate 1112 of agents 612 to be applied. Controller 606 instructs at 1120 one or more applicators 610 to apply the desired agents 612. In this case, FIG. 11 illustrates that friction enhancing agents should be dispensed due to the need to increase the actual tractive effort to match the desired tractive effort. Once the desired tractive effort is obtained in 1104, the process ends. Additionally, if any of the other conditions are not met such as a low tractive effort call 1102, unsatisfactory rail condition 1106, the effectiveness detection system is disabled 1108, or a slip or slide condition is detected 1110, then the process also ends.

Figure 1:
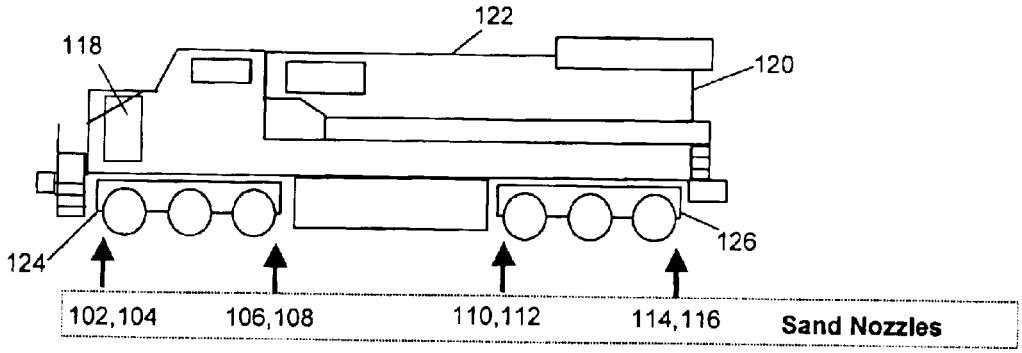
FIG. 1 PRIOR ART
FIG. 1 is a schematic illustration of a prior art locomotive having a sanding system as a friction enhancing system.
Figure 2:
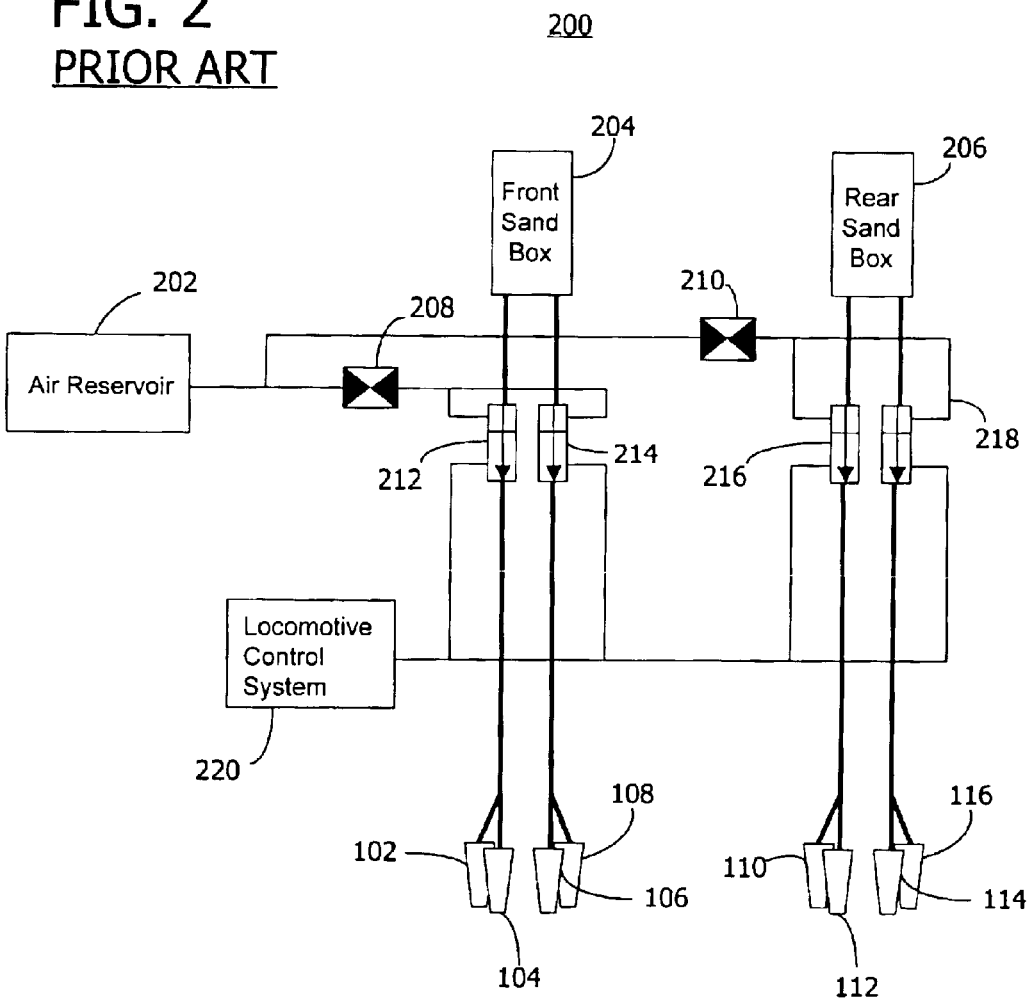
FIG. 2 PRIOR ART
FIG. 2 is a schematic of the prior art sanding system of FIG. 1.
Figure 3:
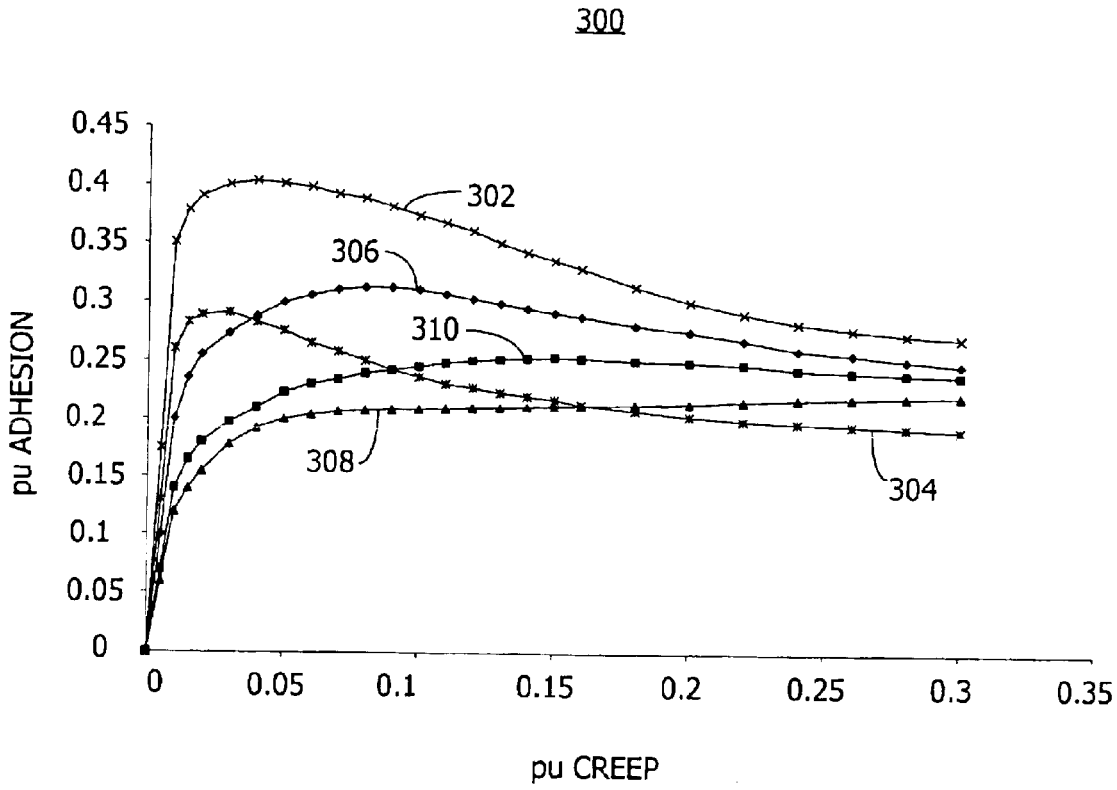
FIG. 3 is an illustration of exemplary adhesion versus creep curves for different rail conditions and friction modifying agents.
Figure 4:
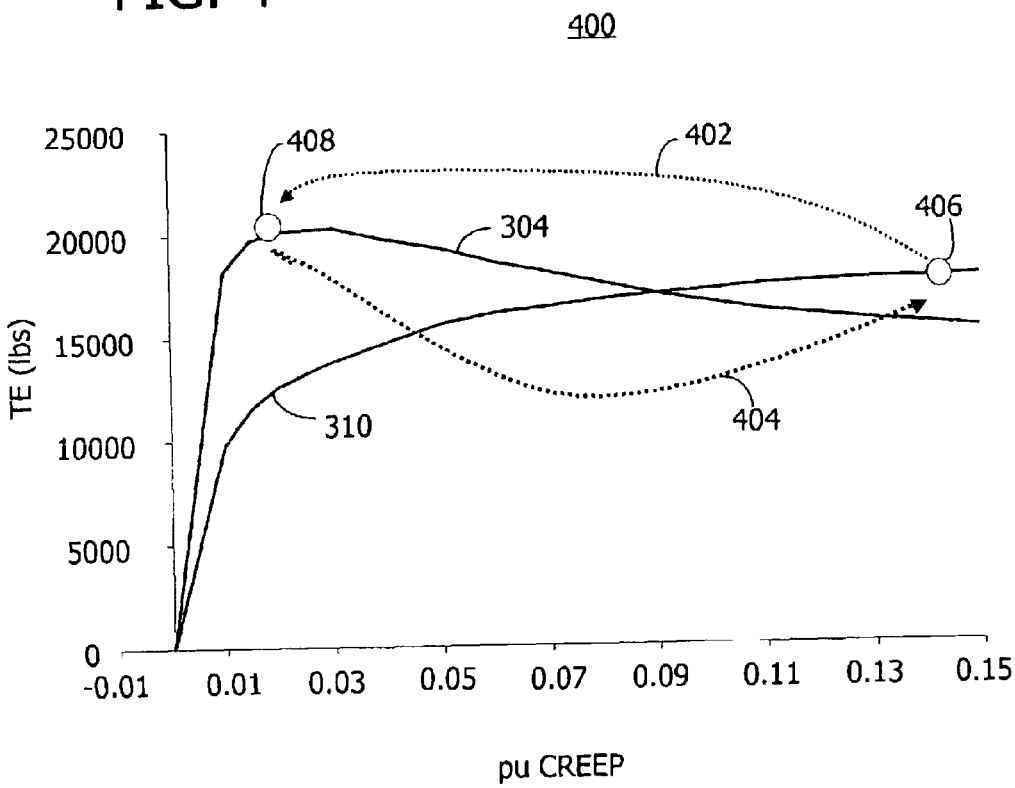
FIG. 4 illustrates exemplary friction/adhesion curves with and without sand applied in front of an axle during wet rail conditions.
Figure 5:
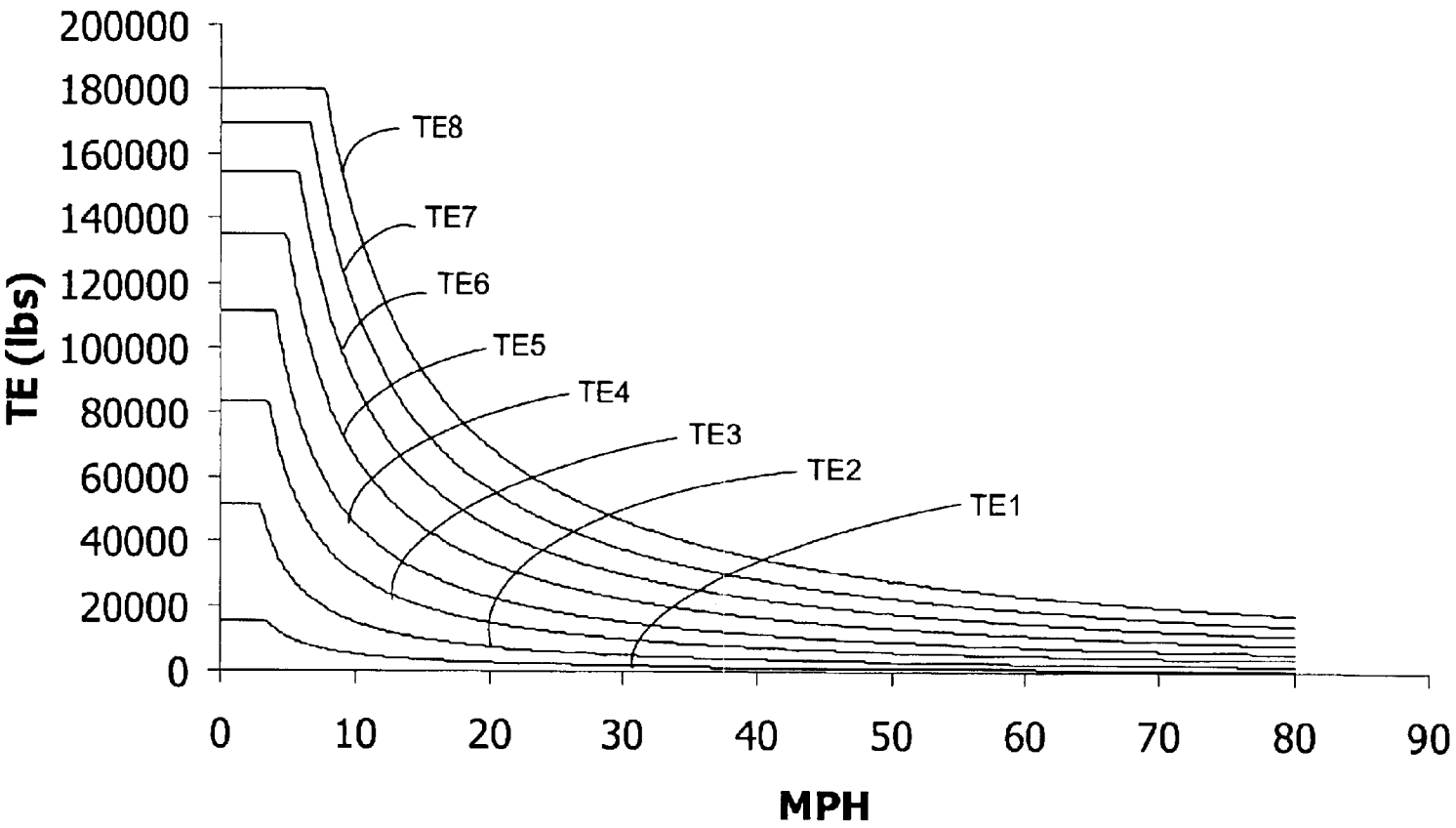
FIG. 5 is an exemplary graph illustrating the tractive effort in pounds in relation to the speed of the train for eight throttle settings.

As noted in FIG. 11, the controller 606 may determine that the conditions are such that friction enhancing agents 612 should not be applied. For instance, the controller 606 may find that the train is equipped with sand as a friction enhancer. However, the controller 606 may obtain the rail conditions that indicate that the rail 710 is wet due to rain or snow. As such, the controller 606 decides that the application of sand to a wet rail may actually reduce the tractive effort rather than increase it as shown in FIG. 4. As such, sand would not be applied. However, the controller 606 may decide that while sand will not provide sufficient enhanced traction, that since the locomotive is equipped with an applicator for applying air to the track, that air should be applied to the rail to dry the rail 710, thereby providing an improved friction.

Figure 12:
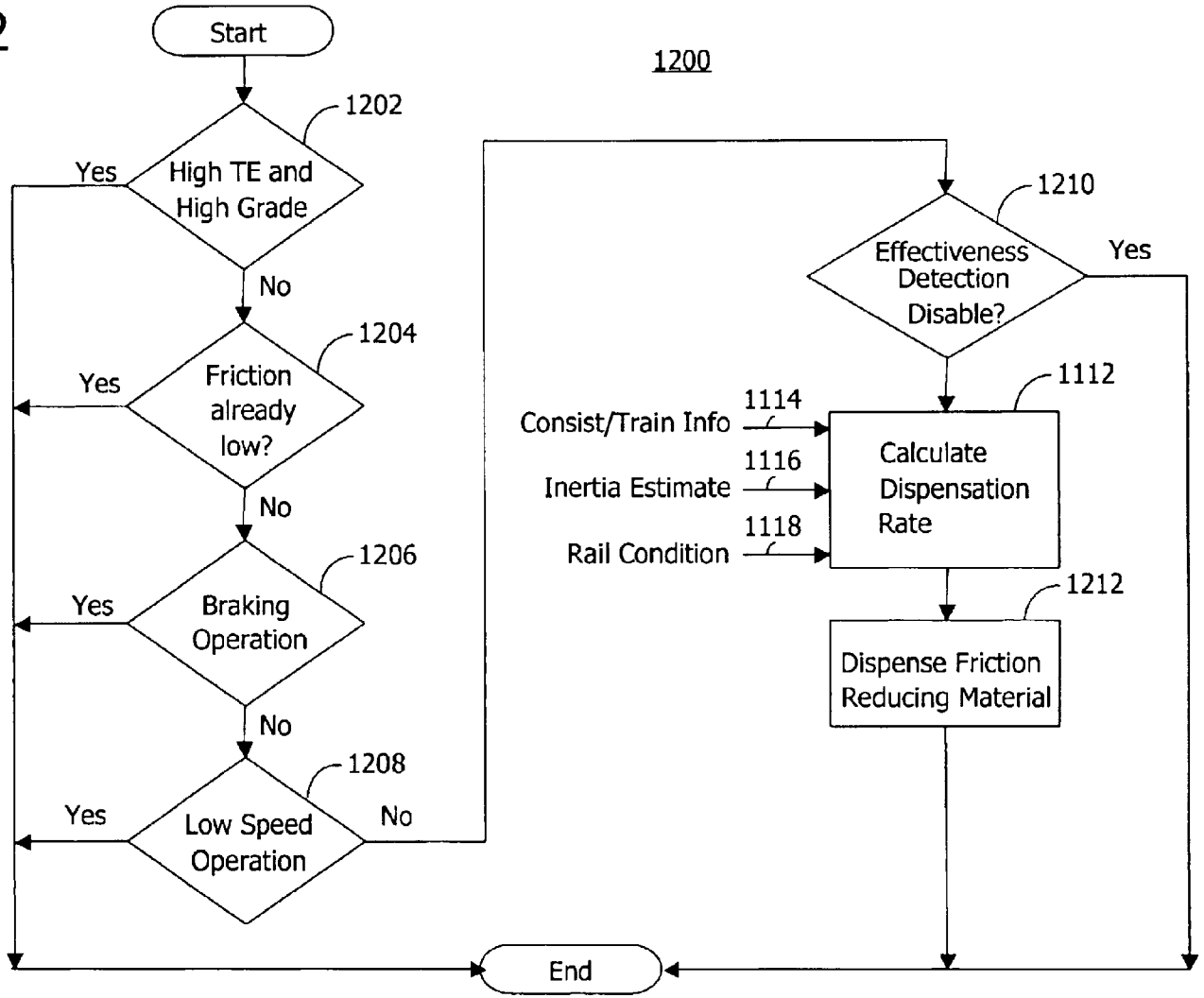
FIG. 12 is an exemplary flow chart for managing and controlling the application of friction reducing agent to the rails according to one embodiment of the invention.

As another example, FIG. 12 illustrates another decision flow chart 1200 for the controller 606 in another embodiment of the invention. In this embodiment, in 1202 the tractive effort is high and a high grade does not currently exist or is not located in the track to be traversed by the train. Controller 606 receives an additional parameter that indicates that the friction is too high 1204 and that a braking operation does not exist in 1206. If the train is operating at a speed that is not too low, a braking operation is not current 1206, and the effectiveness detection is not disabled 1210, controller 606 receives additional auxiliary data 604 as to the train weight, length and configuration 1114, an estimate of the inertia of the train 1116, and the condition 1118 of rail 710. From this data, controller 606 determines the type, quantity, dispensation rate, and location 1112 for applying a friction reducing material 1212. As with the prior example, the controller 606, by receiving input from a variety of parameters 602 and auxiliary data 604, may determine that a friction reducing agent should not be applied. For example, if the tractive effort is high or there is a high grade 1202, if the friction is already low 1204, if there is a braking operation 1206, if there is a low speed operation 1208, or if the effectiveness detection has been disabled, then the system 600 ends the process. This is illustrated in FIG. 12 at each of the decision points going to the "End."

In another embodiment, as noted above knowledge related to the length/weight/power of the consist will be applied to the determination of when and the quantity of the friction modifying agents 612 to be applied. Additionally, a track map based on a CAD system and a GPS location may be used by the controller 606 to determine when and how much and type of agent 612 to be applied. Furthermore, computer aided dispatch systems that gather and analyze train parameter information including the length of the train, weight of the train, the speed of the train and the applied power may be used as an input of auxiliary data 604 to determine when and how much friction modifying agent 612 to apply. A train scheduler/movement planner system and/or RR dispatcher to determine train characteristics are also contemplated as input to the controller 606's determining process.

Another parameter 602 utilized by the friction management system 600 is an inertia estimate based on tractive effort, track grade, speed or tractive effort, GPS position, track map, and speed. The inertia of the train can be determined by the acceleration change per tractive effort change assuming the grade has not changed. If the track grade is also known, then it can be compensated for. The acceleration is obtained from the speed sensors 610 on board the locomotive, the tractive effort is the estimate of force which can be obtained typically from current and voltage measurements on the traction motors (not shown) or it could be obtained from other direct sensors 610. The track grade could be obtained from inclinometers or could be assumed to be the same if the measurements are done over a short period of time. Another technique could use the position of the train, possibly as determined by an on-board global positioning system (GPS) receiver to obtain speed and/or track grade. Another technique could use the track map information based on GPS, operator inputs or side transponders.

Another parameter 602 utilized by the friction management system 600 is speed, throttle setting, and/or tractive effort. The dispensation of both high adhesion material and low adhesion material could be optimized based on the operation of the locomotive. For example, when the consist or train operator calls for high tractive effort (high notch/low speed) then only applicators 712, 714 and 1004 need to be enabled. If the tractive effort produced is what the operator has requested, then there is no need to add friction increasing materials. Most of the fuel efficiency benefits are at high speeds (when tractive effort is low). So under these conditions, only applicators 716 and 902 and optionally applicator 802 need to be enabled. All these variables are available easily on board the locomotive.

As discussed above, the condition of rail 710 is another parameter or item of auxiliary data used to determine optimal friction management. In order to optimize the cost, the dispensing of friction modifying agents 612 can be controlled based on the rail conditions. For example, if rail 710 is dry and clean, then there is no need to dispense high adhesion material. Similarly when there is rain/snow, it may not be necessary to dispense friction-lowering material since the reduction in friction may not be appreciable. Another example is if it is raining or rain is expected before the next train, then there may not be a need to remove low friction material during use of nozzle D. These rail conditions could be inferred based on sensors 610 already on board based on adhesion/creep curves, or could be based on additional sensors 610, or inputs from the dispatch center, operators, external transponders, weather satellites etc.

For rail cars 706 and or idle wheels, creep could be used to estimate the friction coefficient. A separate sensor 610 could be used to determine the coefficient of friction. These sensors 610 could be placed at every point where friction lowering material dispensing is applied or at the end of the locomotive consist. Similarly friction sensors 610 or creep of the last wheel(s) may be used for dispensing neutralizing friction modifying material from applicator 802.

Another factor to be considered is effectiveness detection. It is often necessary to find when these dispensing mechanisms are not working either due to failure or due to lack of friction modifying materials. This is especially important if there are many different kinds of dispensers or if it is difficult to check their operation. For example, if after dispensing high adhesion material, the creep decreases for the same tractive effort or if the tractive effort increases for the same creep or a combination is observed, then the friction modifier is effective. This could be done periodically or whenever the dispensing is initiated. Similarly when the dispensing is terminated, the opposite effect should be observed for proper operation. Similarly when the friction lowering material is dispensed there should be reduction of tractive effort required to maintain the same speed (on the same grade) or there is a speed increase for the same tractive effort. The converse should be observed when the dispensing is stopped. This checking could also be done periodically to ascertain the health of the friction lowering system. These are closed loop systems, which operate in the train. Verification of some of the effects, such as when too much friction lowering material is dispensed (see FIG. 7) or when removal or neutralizing a low adhesion material is not effective (applicator 802), requires observation from subsequent train/locomotive which passes through the same section of track. This locomotive could observe the reduction is adhesion (compared to nominal expected) and conclude that the train ahead is malfunctioning.

As noted earlier, braking conditions are also factors to be considered in friction management. During a braking application, the dispensing requirement changes. No friction lowering material is required and it is advisable to increase the friction coefficient, as high braking effort is required. So during dynamic brake operation or independent brake operation only nozzles 712, 714, 1004 and possibly 802 need to operate. Nozzle 716 and 902 should not be operated. Nozzles 712, 714 and 1004 could be energized based on braking effort call and braking effort obtained and based on rail conditions. Similarly during train air brake operation in addition to turning off nozzles 716 and 902, it may even be necessary to substitute it with friction enhancing material dispensers especially during emergency brake operation to reduce stopping distance. However during light braking/coasting operation friction lowering material could be dispensed if necessary to reduce wheel wear reduction and for preventing too much speed reduction.

During distributed power operation, the dispensing of adhesion lowering material in the lead consist depends on the number/weight of load cars between the lead consist and the trail consist (information of cars between applicators 716 and 1004 in FIG. 10). This information could be obtained using the distance information between the locomotives 704 and 1002. This could be obtained from GPS position information or even using techniques like the time for brake pressure travel information. The dispensing at applicator 716 could be adjusted also based on the friction seen by the trailing locomotive 1002. For example, if the trailing locomotive 1002 encounters very low friction, then too much material is being dispensed by nozzle 716.

When introducing elements of the present invention or the embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A railway train friction management system for managing and controlling an application of one or more of a plurality of types of friction modifying agents to an area of contact between a railway wheel and a railway rail over which the wheel is traversing to selectively modify the coefficient of friction at the contact area, the system comprising:

a sensor for detecting a parameter relating to an operation of the railway train;

a controller responsive to the sensor for selecting at least one type of friction modifying agent as a function of the detected parameter and for determining a period of time for application of the selected friction modifying agent to the rail as a function of the detected parameter, and an applicator responsive to the controller for applying the selected type of friction modifying agent to the area of contact between the railway wheel and the rail for the period of time.

2. The system of claim 1, further comprising a locomotive having a first end and a second end, one of which is a leading end and the other of which is a trailing end; wherein the applicator is positioned on the trailing end of the locomotive and applies the friction modifying agent to the rail to reduce the coefficient of friction at the contact area for reduced wear and rolling resistance.

3. The system of claim 1, wherein the applicator is positioned on a railway car traversing the railway rail and being moved by a locomotive along the railway rail such that the applicator applies the friction modifying agent to reduce the coefficient of friction at the contact area for reduced wear and rolling resistance.

4. The system of claim 1, wherein the friction modifier agent is one that increases the coefficient of friction at the contact area for enhanced adhesion.

5. The system of claim 4, wherein the friction modifier agent is one from a group of agents comprising sand, sand-like material, and air.

6. The system of claim 1, wherein the friction modifier agent is one that decreases the coefficient of friction at the contact area for diminished adhesion.

7. The system of claim 6, wherein the friction modifier agent is one from a group of agents comprising air, steam, water, lubricating fluid, and oil.

8. The system of claim 1, wherein the friction modifier agent is one that removes another friction modifier agent from the contact area.

9. The system of claim 1, wherein the parameter is selected from the group of parameters comprising train speed, wheel speed, tractive effort (TE), throttle setting, acceleration, deceleration, braking condition, force, wheel slip/slide, fuel consumption, wheel creep, engine horsepower, and traction motor torque.

10. The system of claim 1, further comprising auxiliary data wherein the controller retrieves the auxiliary data and is responsive to the parameter and the auxiliary data for controlling the application of the friction modifying agent to the rail.

11. The system of claim 10, wherein the auxiliary data is selected from a group of auxiliary data comprising train length, train weight, track map, train location, track topography, track grade, track curvature, rail temperature, rail condition, current weather, forecast weather, train schedules, commands from operators, and commands from remote dispatch centers.

12. The system of claim 1, wherein the applicator is configured to apply the friction modifying agent to a defined point of a rail configuration and wherein the controller controls the application of the friction modifying agent to the defined point of rail configuration.

13. The system of claim 12, wherein the defined point of application is selected from a group of points of application comprising a wheel flange, a wheel rim, a top of the rail, and a rail gage side.

14. The system of claim 1, wherein the controller determines timing of the application of the friction modifying agent by the applicator.

15. The system of claim 1, wherein the controller determines quantity of the application of the friction modifying agent by the applicator.

16. The system of claim 1, wherein the detected parameter indicates a sensed tractive effort, and wherein the controller determines the period of time for applying the selected friction modifying agent as a function of a comparison of the sensed tractive effort to a desired tractive effort.

17. The system of claim 16, wherein the controller determines to begin application of the friction modifying agent when the sensed tractive effort is lower than the desired tractive effort, and wherein the controller determines to end application of the friction modifying agent at the when the sensed tractive effort is equal to or greater than the desired tractive effort.

18. A method for railway train friction management for managing and controlling an application of one or more of a plurality of types of friction modifying agent to an area of contact between a railway wheel of a railway train and a railway rail over which a wheel is traversing to selectively modify a coefficient of friction at the contact area, the method comprising:

sensing a parameter related to the operation of the railway train;

selecting at least one type of friction modifying agent as a function of the sensed parameter; and applying the selected type of friction modifying agent to the area of contact between the railway wheel and rail as a function of the sensed parameter.

19. The method according to claim 18, further comprising determining the timing of applying the friction modifying agent and the quantity of friction modifying agent to be applied based on the sensed parameter, wherein the controlling is based on the determining of the timing and the quantity.

20. The method according to claim 18 wherein applying the friction modifying agent includes applying a friction enhancing agent to enhance the friction of a wheel of a locomotive and applying a friction reducing agent to the rail prior to a wheel of a connected railway car.

21. The method according to claim 18, further comprising controlling the application of a friction modifying agent to the rail responsive to the sensed parameter.

22. A railway train friction management system for managing and controlling an application of one or more of a plurality of types of friction modifying agents to an area of contact between a railway wheel and a railway rail over which the wheel is traversing to selectively modify the coefficient of friction at the contact area, the system comprising:

a plurality of sensors for detecting parameters relating to an operation of the railway train;

at least one controller responsive to input from at least one of the plurality of sensors for selecting at least one type of friction modifying agent as a function of the detected parameter and determining an amount of the selected friction modifying agent to apply to the rail as a function of at least one of the sensed parameters; and a plurality of applicators responsive to at least one controller for applying the determined amount of the selected type of friction modifying agent to the area of contact between the railway wheel and rail.

23. The system of claim 22 including a train comprising a plurality of locomotives and a plurality of railway cars each having a plurality of railway wheels and at least some of the locomotives and/or railway cars having applicators thereon and wherein the at least one controller determines which applicators are to be operated to apply friction modifying agent to the area of contact between the railway wheel and rail.

24. The system of claim 23 further comprising each locomotive having a first end and a second end, one of which is a leading end and the other of which is a trailing end; wherein the applicators are positioned on either or both the leading end and the trailing end of at least some of the locomotives.

25. The system of claim 22 wherein the friction modifier agent is one that increases the coefficient of friction at the contact area for enhanced adhesion.

26. The system of claim 25, wherein the friction modifier agent is one from a group of agents comprising sand, sand-like material, and air.

27. The system of claim 22 wherein the friction modifier agent is one that decreases the coefficient of friction at the contact area for enhanced adhesion.

28. The system of claim 27, wherein the friction modifier agent is one from a group of agents comprising air, steam, water, lubricating fluid, and oil.

29. The system of claim 22, wherein the friction modifier agent is one that removes another friction modifier agent from the contact area.

30. The system of claim 22, wherein the at least one parameter is selected from the group of parameters comprising train speed, wheel speed, tractive effort (TE), throttle setting, acceleration, deceleration, braking condition, force, wheel slip/slide, fuel consumption, wheel creep, engine horsepower, and traction motor torque.

31. The system of claim 22, further comprising auxiliary data wherein the controller retrieves the auxiliary data and is responsive to at least one parameter and the auxiliary data for controlling the application of a friction modifying agent to the rail.

32. The system of claim 31, wherein the auxiliary data is selected from a group of auxiliary data comprising train length, train weight, track map, train location, track topography, track grade, track curvature, rail temperature, rail condition, current weather, forecast weather, train schedules, commands from operators, and commands from remote dispatch centers.

33. The system of claim 22, wherein the applicators are configured to apply the friction modifying agent to a defined point of a rail configuration and wherein the controller controls the application of the friction modifying agent to the defined point of rail configuration.

34. The system of claim 33, wherein the defined point of application is selected from a group of points of application comprising a wheel flange, a wheel rim, a top of the rail, and a rail gage side.

35. The system of claim 22, wherein the at least one controller determines timing of the application of the friction modifying agent by the applicators.

36. The system of claim 22, wherein the controller determines quantity of the application of the friction modifying agent by the applicators.

37. The system of claim 22 wherein at least one controller determines the amount of the selected friction modifying agent to apply to the rail by determining a quantity or a dispensation rate of the friction modifying agent to be applied.

38. A method for railway train friction management for managing and controlling an application of one or more of a plurality of types of friction modifying agent to an area of contact between railway wheel of a railway train and railway rail over which the wheel is traversing to selectively modify the coefficient of friction at the contact area, the method comprising:

sensing at least one parameter related to an operation of the railway train;

selecting at least one type of friction modifying agent as a function of the at least one sensed parameter; and applying at least one of the selected type of friction modifying agent to a selected area of contact between the railway wheel and rail as a function of the at least one sensed parameter.

39. The method according to claim 38, further comprising determining the timing of applying the friction modifying agent based on the sensed parameter, wherein the controlling is based on the determining of the timing.

40. The method according to claim 38, further comprising determining the quantity of friction modifying agent to be applied based on the sensed parameter, wherein the controlling is based on the determining of the quantity.

41. The method according to claim 38, further comprising determining the timing of applying the friction modifying agent and the quantity of friction modifying agent to be applied based on the sensed parameter, wherein the controlling is based on the determining of the timing and the quantity.

42. The method according to claim 38, wherein the step of applying the at least one friction modifying agent includes applying a friction enhancing agent to enhance the friction of a wheel of a locomotive and applying a friction reducing agent to the rail prior to a wheel of a connected railway car.

43. The method according to claim 38, further comprising controlling the application of the friction modifying agent to the rail responsive to the at least one sensed parameter.

44. The method of claim 38 wherein the train includes a plurality of locomotives and a plurality of railway cars each having a plurality of railway wheels and one or more of the locomotives and/or railway cars have friction modifying applicators thereon and wherein the controlling of the friction modifying agent includes selecting which applicators are to be operated to apply friction modifying agent to the area of contact between the railway wheel and rail and then applying the friction modifying agent through operation of the selected applicators.

45. The method of claim 38 wherein the step of applying at least one friction modifying agent includes applying one that increases the coefficient of friction at the contact area.

46. The method of claim 45 wherein the step of applying at least one friction modifying agent includes applying at least one selected from a group of agents comprising sand, sand-like material, and air.

47. The method of claim 38 wherein the step of applying at least one friction modifying agent includes applying one that decreases the coefficient of friction at the contact area.

48. The method of claim 47 wherein the step of applying at least one friction modifying agent includes applying at least one selected from a group of agents comprising air, steam, water, lubricating fluid, and oil.

49. The method of claim 38 wherein the step of applying at least one friction modifying agent includes applying one that removes another friction modifier agent from the contact area.

50. The method of claim 38 wherein the step of selecting at least one parameter includes selecting from the group of parameters comprising train speed, wheel speed, tractive effort (TE), throttle setting, acceleration, deceleration, braking condition, force, wheel slip/slide, fuel consumption, wheel creep, engine horsepower, and traction motor torque.

51. The method of claim 38, further comprising the selection of auxiliary data and the applying of at least one modifying agent is a function of the auxiliary data and the at least one parameter.

52. The method of claim 51 wherein the auxiliary data is selected from a group of auxiliary data comprising train length, train weight, track map, train location, track topography, track grade, track curvature, rail temperature, rail condition, current weather, forecast weather, train schedules, commands from operators, and commands from remote dispatch centers.

53. A railway train friction management system for managing and controlling an application of one or more of a plurality of types of friction modifying agents to an area of contact between a railway wheel and a railway rail over which the wheel is traversing to selectively modify the coefficient of friction at the contact area, the system comprising:

a sensor for detecting a parameter relating to an operation of the railway train;

a controller responsive to the sensor for determining whether to apply a friction enhancing agent or a friction diminishing agent on the rail as a function of the detected parameter and for determining an amount of the determined agent to apply to the rail as a function of the detected parameter; and an applicator responsive to the controller for applying the determined amount of the determined type of friction modifying agent to the area of contact between the railway wheel and the rail.

* * * * *